US010589553B2

(12) United States Patent
Tanaka

(10) Patent No.: US 10,589,553 B2
(45) Date of Patent: Mar. 17, 2020

(54) LIQUID JETTING APPARATUS

(71) Applicant: Brother Kogyo Kabushiki Kaisha, Nagoya-shi, Aichi-ken (JP)

(72) Inventor: Taiki Tanaka, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/261,700

(22) Filed: Jan. 30, 2019

(65) Prior Publication Data

US 2019/0291487 A1 Sep. 26, 2019

(30) Foreign Application Priority Data

Mar. 23, 2018 (JP) ..... 2018-056800

(51) Int. Cl.
*B41J 29/377* (2006.01)
*B41J 2/14* (2006.01)

(52) U.S. Cl.
CPC ..... *B41J 29/377* (2013.01); *B41J 2/14201* (2013.01); *B41J 2/1408* (2013.01); *B41J 2002/14491* (2013.01)

(58) Field of Classification Search
CPC ..... B41J 29/377; B41J 2/1408
See application file for complete search history.

(56) References Cited

U.S. PATENT DOCUMENTS 9,487,007 B2 11/2016 Sugiura et al.
2004/0227788 A1 11/2004 Katayama
2004/0263554 A1* 12/2004 Kubo ..... B41J 2/14 347/18
2016/0221337 A1 8/2016 Sugiura et al.

FOREIGN PATENT DOCUMENTS

JP 2004-291542 A 10/2004
JP 2008-126629 * 6/2008 ..... B41J 2/05
JP 2016-140987 A 8/2016

* cited by examiner

*Primary Examiner* — Julian D Huffman
(74) *Attorney, Agent, or Firm* — Banner & Witcoff, Ltd.

(57) ABSTRACT

A liquid jetting apparatus includes: a liquid jetting module having drive elements; a wiring member including: a base material having a first surface; wirings formed on the first surface of the base material; and a protective film configured to covers the first surface of the base material and the wirings; and a heat sink. One of the protective film and the base material, of the wiring member, is formed with an opening through which at least some of the wirings are partially exposed, the wirings of the wiring member are electrically connected to terminals of the drive elements, and the heat sink is joined to the at least some of the wirings via the opening of the wiring member.

16 Claims, 13 Drawing Sheets

LIQUID JETTING APPARATUS

CROSS REFERENCE TO RELATED APPLICATION

The present application claims priority from Japanese Patent Application No. 2018-056800, filed on Mar. 23, 2018, the disclosure of which is incorporated herein by reference in its entirety.

BACKGROUND

Field of the Invention

The present invention relates to a liquid jetting apparatus.

Description of the Related Art

From the past, there is known a liquid jetting apparatus that includes: a channel substrate having liquid channels formed therein: piezoelectric elements provided for the channel substrate to correspond to the liquid channels; and a wiring member equipped with a driver IC. The piezoelectric elements have drive contacts led out to a surface, of the channel substrate, provided with the piezoelectric elements. As a result of the wiring member being joined to the channel substrate, the driver IC is electrically connected to the piezoelectric elements via the drive contacts, and outputs a drive signal to each of the piezoelectric elements. In order to dissipate heat generated from the driver IC when driving the piezoelectric elements, a heat sink is provided to be in contact with the driver IC.

In addition, there is known a recording apparatus including: a flexible wiring substrate having conductive wires and a driver IC that drives a recording head; and a heat sink that dissipates, to outside, heat generated by the driver IC. The heat sink is closely adhered to a surface, of the flexible wiring substrate, on an opposite side to a surface provided with the driver IC, at a position facing the driver IC.

SUMMARY

In the liquid jetting apparatus described above, there is a risk that the heat generated by the driver IC is not only transmitted to the heat sink, but is also transmitted as far as a joining portion of the wiring member and the channel substrate, via the wiring member provided with the driver IC. Now, thermal expansion coefficients differ between the drive contacts of the piezoelectric elements and the wiring member (in more detail, an adhesive by which the wiring member is joined to the channel substrate). Therefore, there is a risk that when the heat generated by the driver IC is transmitted as far as the joining portion of the wiring member and the drive contacts, via the wiring member, an internal stress occurs between the adhesive of the wiring member and the drive contacts, and the wiring member is detached from the channel substrate.

On the other hand, in the recording apparatus described above, the flexible wiring substrate made of resin is interposed between the driver IC and the heat sink. Therefore, there is a risk that some of the heat generated by the driver IC is transmitted as far as a joining portion of the flexible wiring substrate and the recording head, via the flexible wiring substrate.

The present teaching was made in view of such circumstances, and has an object of providing a liquid jetting apparatus in which heat from a driver IC is hardly transmitted to a joining portion of a wiring member and a channel substrate.

According to a first aspect of the present teaching, there is provided a liquid jetting apparatus including: a liquid jetting module having drive elements; a wiring member including: a base material having a first surface; wirings formed on the first surface of the base material; and a protective film configured to covers the first surface of the base material and the wirings; and a heat sink, wherein one of the protective film and the base material, of the wiring member, is formed with an opening through which at least some of the wirings are partially exposed, the wirings of the wiring member are electrically connected to terminals of the drive elements, and the heat sink is joined to the at least some of the wirings via the opening of the wiring member.

According to a second aspect of the present teaching, there is provided a liquid jetting apparatus including: a liquid jetting module having drive elements; a wiring member including: a base material having a first surface; wirings formed on the first surface of the base material; and a protective film configured to cover the first surface of the base material and the wirings, one of the protective film and the base material being formed with an opening through which at least some of the wirings are partially exposed; a heat spreader joined to the at least some of the wirings via the opening of the wiring member; and a heat sink being a separate member from the heat spreader and being in contact with the heat spreader, wherein the wirings of the wiring member are electrically connected to terminals of the drive elements.

DESCRIPTION OF THE EMBODIMENTS

Figure 1:
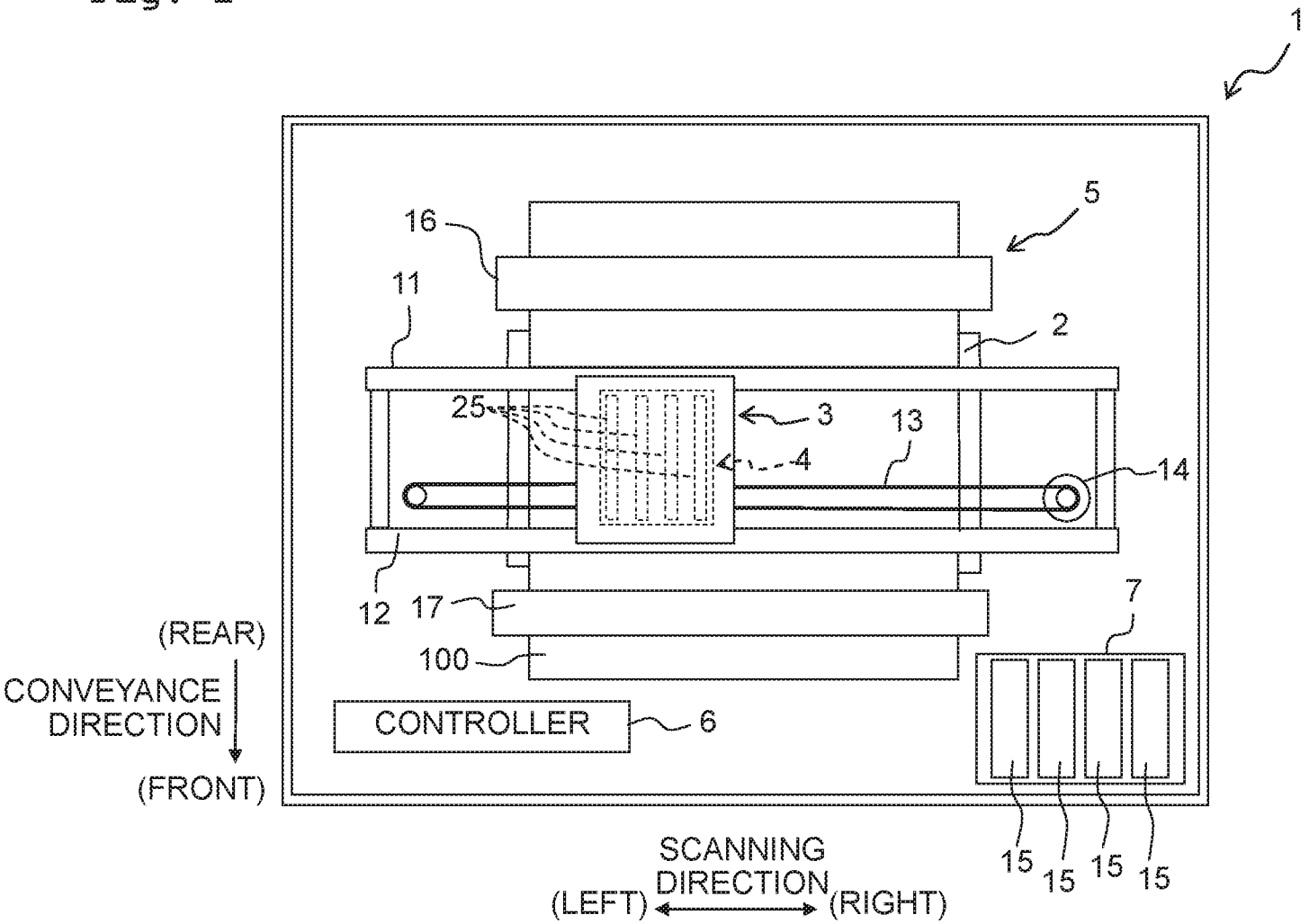
FIG. 1 is a schematic plan view of a printer according to the present embodiment.

An embodiment of the present teaching will be described. First, a schematic configuration of an ink-jet printer 1 will be described with reference to FIG. 1. Note that each of directions of front, rear, left, and right depicted in FIG. 1 are defined as "front", "rear", "left", and "right" of the printer. Moreover, this side of the paper surface is defined as "up", and the far side of the paper surface is defined as "down". Hereafter, description will proceed making appropriate use of words for each of the directions of front, rear, left, right, up, and down.

<Schematic Configuration of Printer>

As depicted in FIG. 1, the ink-jet printer 1 mainly includes a platen 2, an ink jetting apparatus 3 (an example of a liquid jetting apparatus of the present teaching), a cartridge holder 4, a conveyance mechanism 5, and a controller 6.

A recording sheet 100 as a recording medium is placed on an upper surface of the platen 2. The ink jetting apparatus 3 includes an ink-jet head 21. The ink-jet head 21 includes four head units 25 (each an example of a liquid jetting module of the present teaching) which jet ink onto the recording sheet 100 placed on the platen 2. The ink jetting apparatus 3 is configured to reciprocate in a left-right direction (hereafter, also referred to a scanning direction) along two guide rails 11, 12 in a region facing the platen 2. An endless belt 13 is coupled to the ink jetting apparatus 3. The endless belt 13 is driven by a drive motor 14, whereby the ink jetting apparatus 3 moves in the scanning direction. The ink jetting apparatus 3, while moving in the scanning direction, jets ink toward the recording sheet 100 placed on the platen 2 from nozzles of each of the head units 25.

Four ink cartridges 15 respectively storing inks of four colors (black, yellow, cyan, magenta) are installed in a removable manner in the cartridge holder 4. The cartridge holder 4 is connected to the ink jetting apparatus 3 by unillustrated tubes. The four colors of inks respectively stored in the four ink cartridges 15 of the cartridge holder 4 are supplied to the ink jetting apparatus 3 via the tubes.

The conveyance mechanism 5 has two conveyance rollers 16, 17 that are disposed so as to sandwich the platen 2 in a front-rear direction. The two conveyance rollers 16, 17 are driven synchronously with each other by an unillustrated conveyance motor. The conveyance mechanism 5 conveys the recording sheet 100 placed on the platen 2, in a frontward direction (hereafter, also referred to a conveyance direction), by the two conveyance rollers 16, 17.

The controller 6 includes the likes of a ROM (Read Only Memory), a RAM (Random Access Memory), and an ASIC (Application Specific Integrated Circuit) that includes various kinds of control circuits. The controller 6 executes various kinds of processing, such as printing, on the recording sheet 100, by the ASIC, according to a program stored in the ROM. For example, in a printing processing, the controller 6 controls the ink jetting apparatus 3, the drive motor 14, the conveyance motor (illustration of which is omitted) of the conveyance mechanism 5, and so on, to print an image or the like on the recording sheet 100, based on a printing instruction inputted from an external apparatus such as a PC. Specifically, the controller 6, while moving the ink jetting apparatus 3 in the scanning direction, causes alternate execution of an ink jetting operation in which ink is jetted from the nozzles of the four head units 25 and a conveyance operation that conveys the recording sheet 100 a certain amount in the conveyance direction by the conveyance rollers 16, 17.

<Detailed Configuration of Ink Jetting Apparatus>

Figure 2:
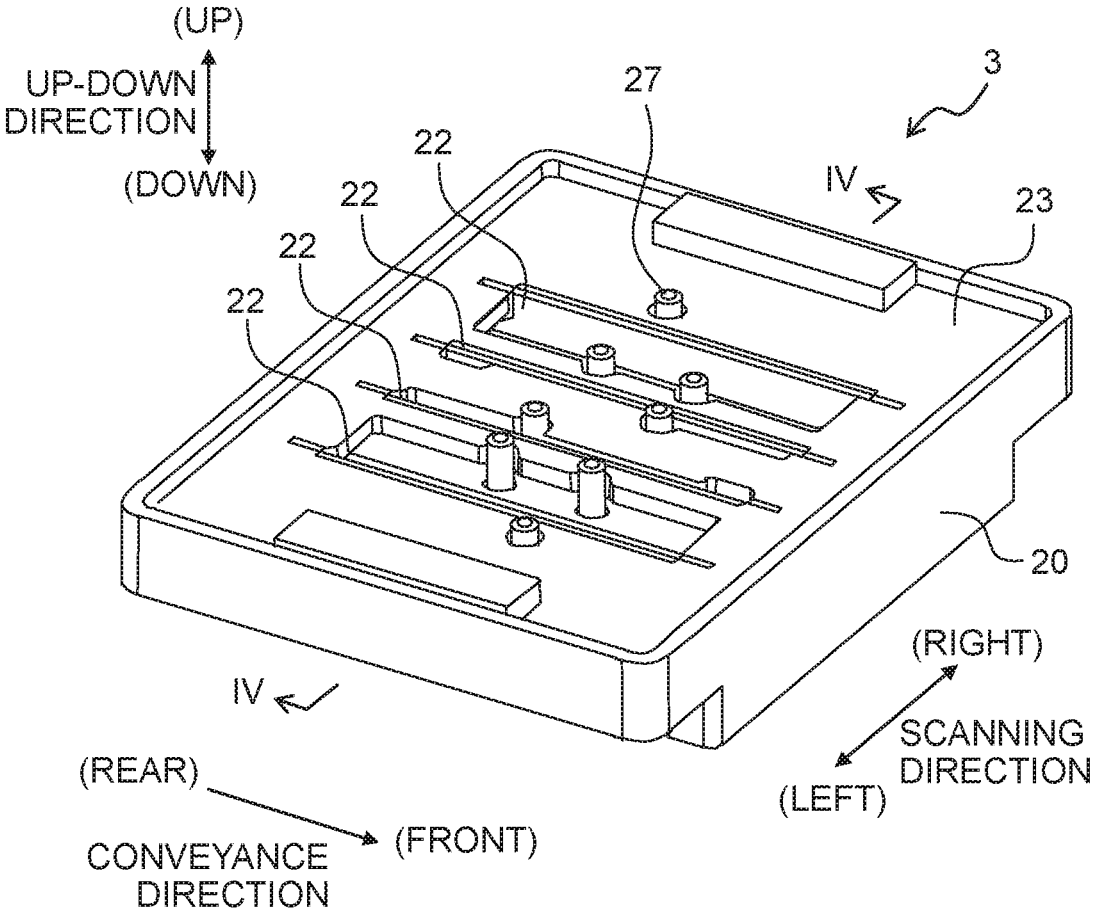
FIG. 2 is a perspective view of an ink jetting apparatus.
Figure 3:
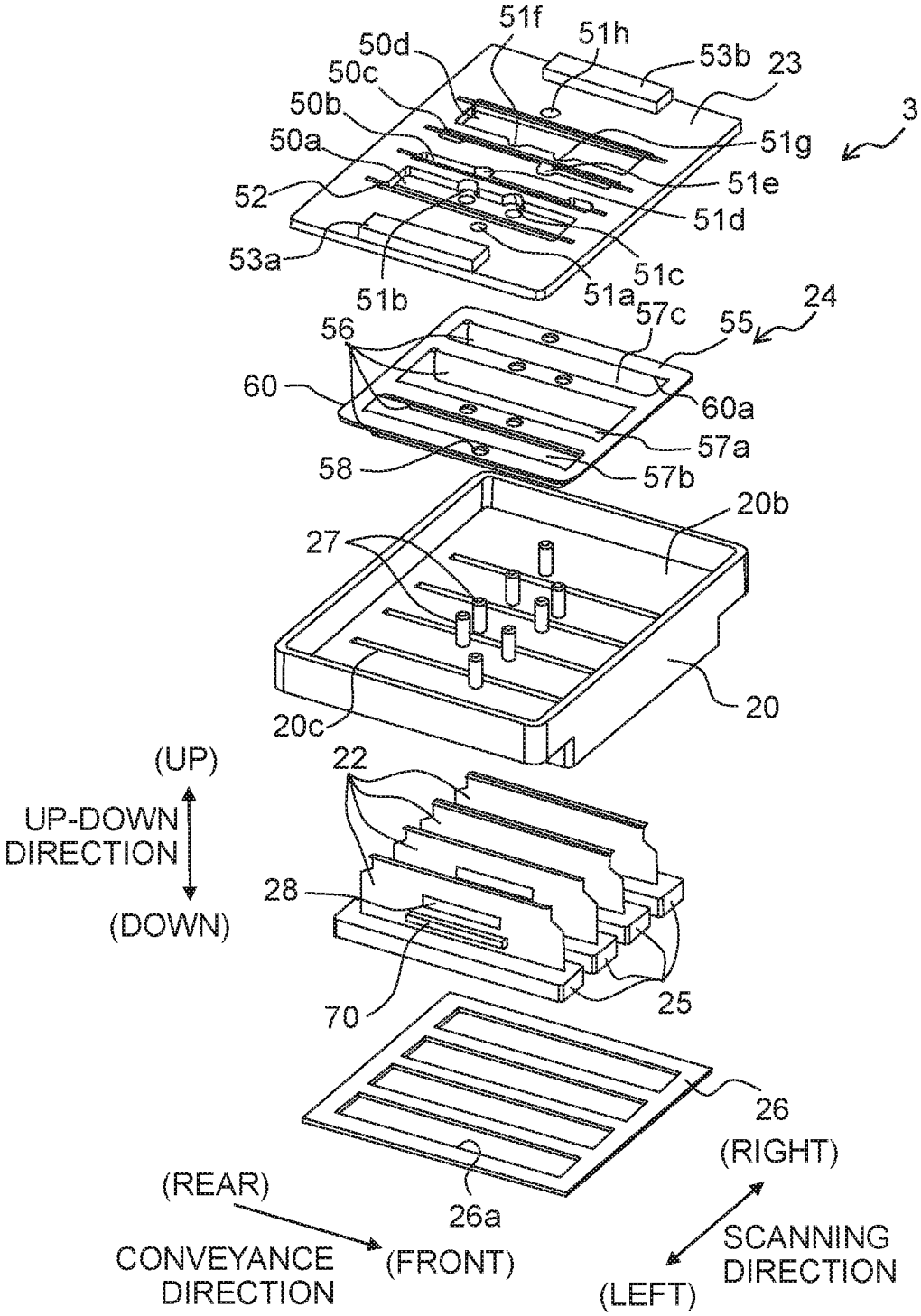
FIG. 3 is an exploded perspective view of the ink jetting apparatus.
Figure 4:
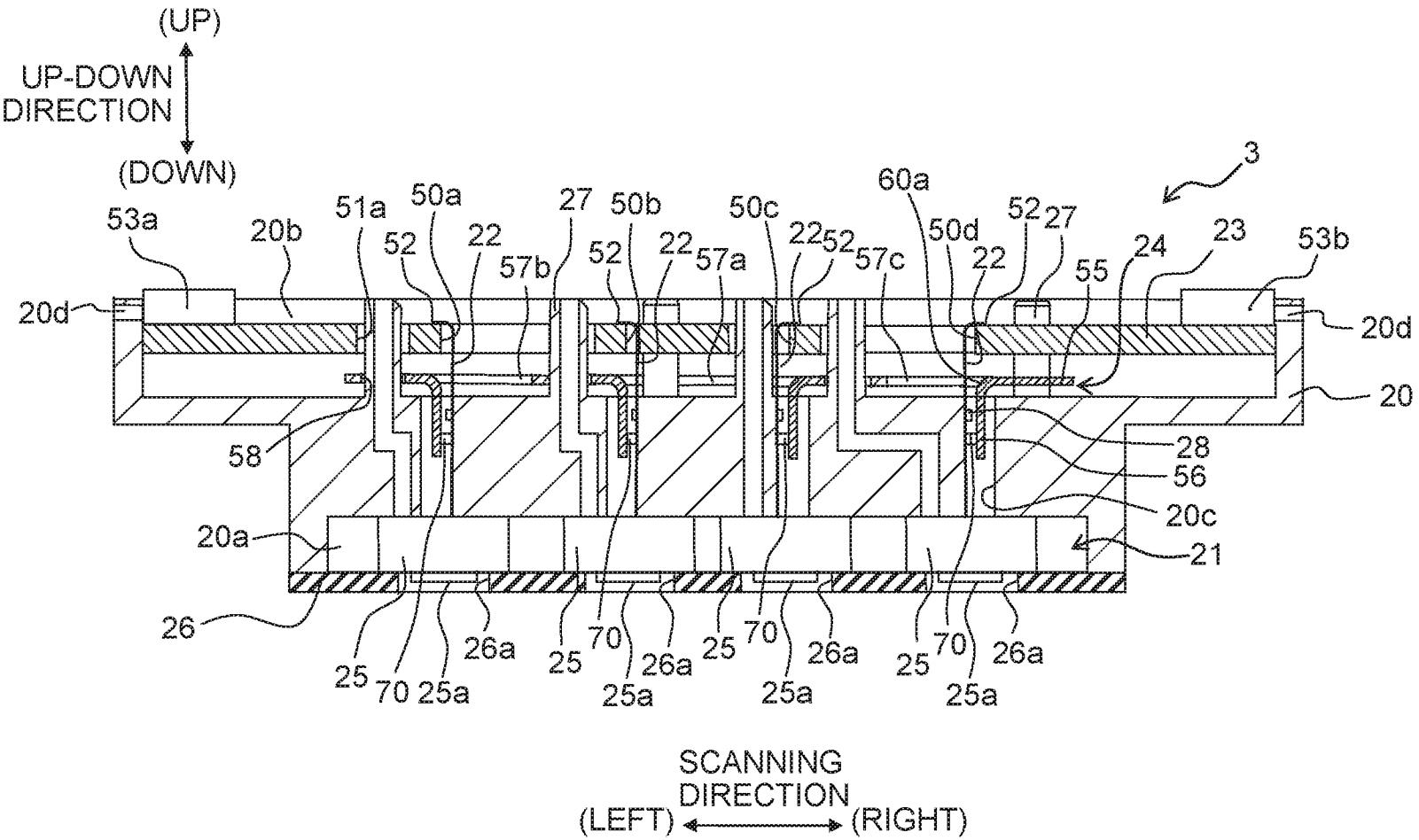
FIG. 4 is a cross-sectional view taken along the line IV-IV of FIG. 2.

Next, a detailed configuration of the ink jetting apparatus 3 will be described. As depicted in FIGS. 2 to 4, the ink jetting apparatus 3 includes: a head holder 20; the ink-jet head 21 including the four head units 25; four COFs 22; a circuit substrate 23; a heat sink 24, and so on.

<Head Holder>

The head holder 20 has a rectangular planar shape which is long in the scanning direction. The head holder 20 is coupled to the endless belt 13 driven by the drive motor 14 (refer to FIG. 1), and is capable of moving in the scanning direction along the guide rails 11, 12. As depicted in FIG. 4, a unit housing portion 20*a* of concave shape is formed in a lower portion of the head holder 20. The unit housing portion 20*a* houses the four head units 25 of the ink-jet head 21. Moreover, as depicted in FIGS. 3 and 4, a substrate housing portion 20*b* of concave shape is formed in an upper portion of the head holder 20. The substrate housing portion 20*b* houses the circuit substrate 23 and the heat sink 24.

As depicted in FIGS. 3 and 4, the substrate housing portion 20*b* of the head holder 20 is provided with eight cylindrical channels 27 that extend upwardly from a bottom surface of the substrate housing portion 20*b*. The eight cylindrical channels 27 respectively correspond to eight nozzle rows 31 of the four head units 25. The eight cylindrical channels 27 are connected to the cartridge holder 4 (refer to FIG. 1). The four colors of inks respectively stored in the four ink cartridges 15 of the cartridge holder 4 are supplied to the eight cylindrical channels 27. Note that from one ink cartridge 15, one color of ink is supplied to two cylindrical channels 27. Moreover, although not illustrated in the drawings, the head holder 20 has formed therein ink channels that connect the eight cylindrical channels 27 and the four head units 25. As depicted in FIGS. 3 and 4, four passing holes 20*c* are formed in the head holder 20. The four COFs 22 corresponding to the four head units 25 are respectively inserted in the four passing holes 20*c*.

<Ink-Jet Head>

As depicted in FIGS. 3 and 4, the ink-jet head 21 includes the four head units 25 and a unit holding plate 26 that holds the four head units 25. The four head units 25 are housed in the unit housing portion 20*a* of the head holder 20, in a state of being aligned at intervals in the scanning direction.

Figure 5:
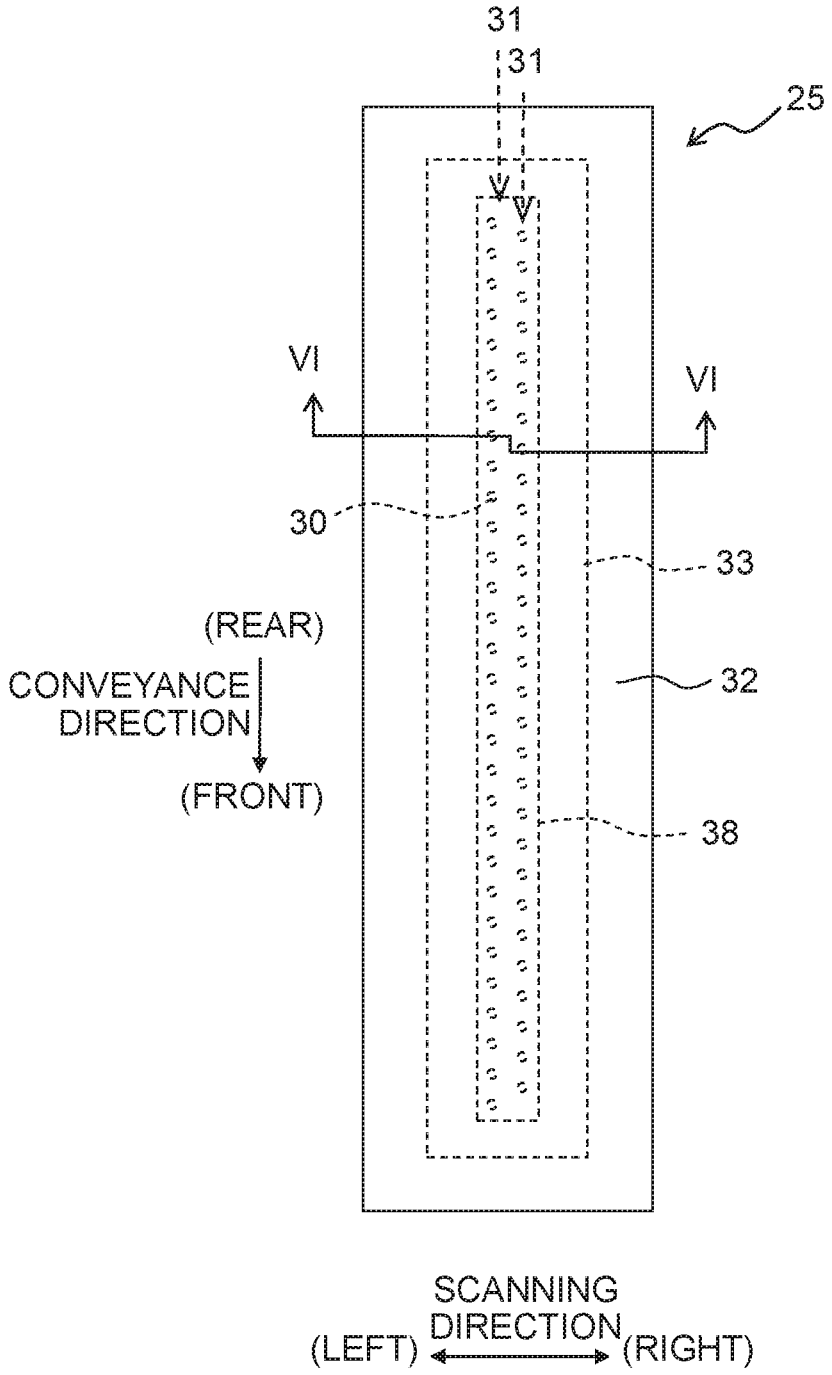
FIG. 5 is a plan view of a head unit.
Figure 6:
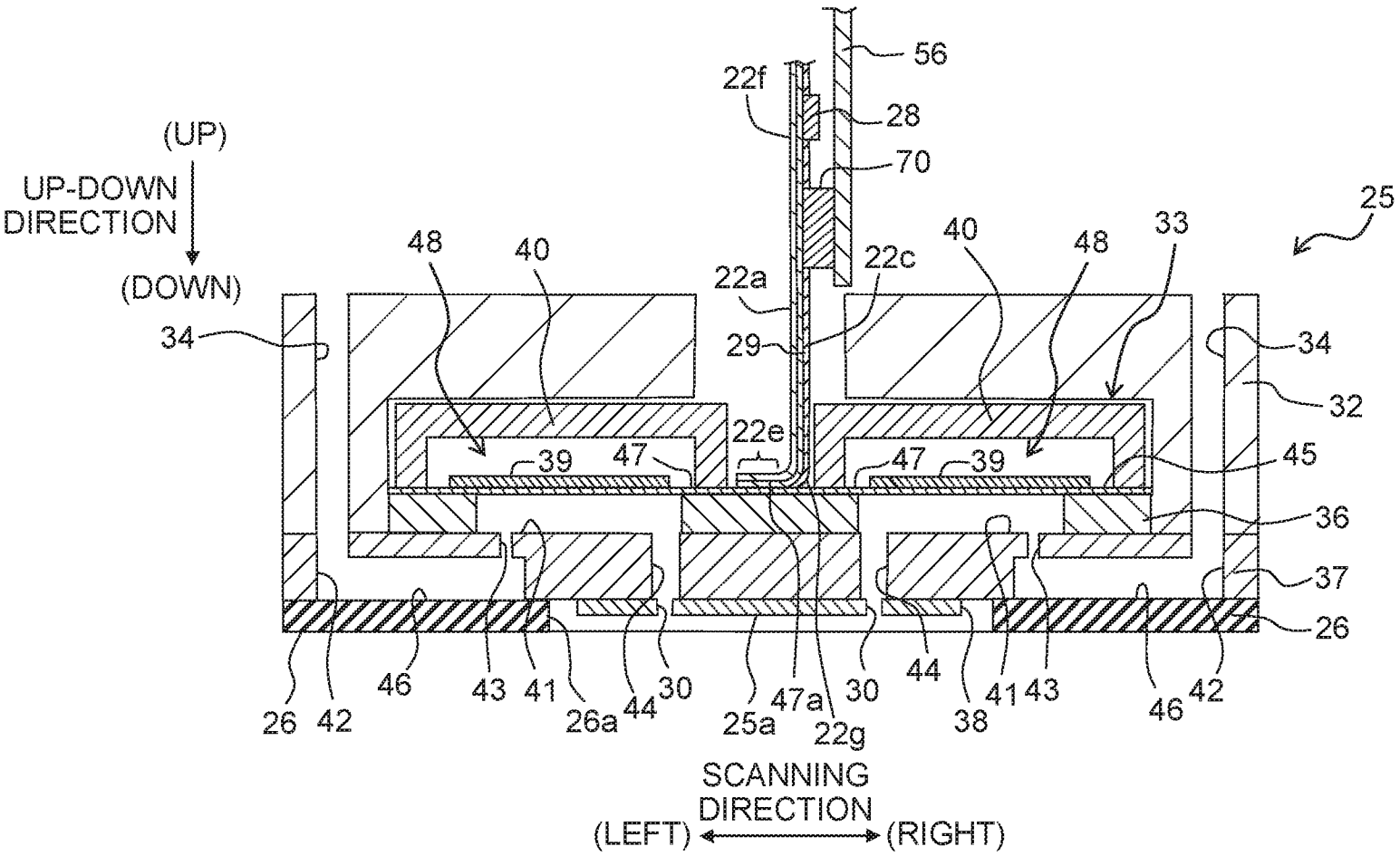
FIG. 6 is a cross-sectional view taken along the line VI-VI of FIG. 5.

As depicted in FIGS. 5 and 6, jetting ports of nozzles 30 are formed in a lower surface of each of the head units 25. In the description below, a region having formed therein the jetting ports of the nozzles 30, of the lower surface of the head unit 25, will be referred to as an ink jetting surface 25*a*. In the ink jetting surface 25*a*, the nozzles 30 form two nozzle rows 31 arranged in the scanning direction. Each of the nozzle rows 31 extends in the conveyance direction.

Since one head unit 25 has two nozzle rows 31, the ink-jet head 21 has a total of eight nozzle rows 31. The eight nozzle rows 31 and the eight cylindrical channels 27 of the head holder 20 correspond to each other, and each of the nozzle rows 31 is supplied with one of the four colors of inks, from a corresponding cylindrical channel 27. That is, one color of ink supplied to the ink jetting apparatus 3 from one ink cartridge 15 is supplied to two nozzle rows 31 of the eight nozzle rows 31, via two cylindrical channels 27. Note that regarding what color of ink is jetted by each of the eight nozzle rows 31, this is not limited to a specific combination, and may be appropriately selected. For example, the same color of ink may be jetted from the two nozzle rows of one head unit 25. Alternatively, four kinds of nozzle rows 31 respectively discharging the four colors of inks may be disposed with left-right symmetry in the scanning direction. For example, the four kinds of nozzle rows 31 may be disposed in order of black, magenta, cyan, and yellow, from a center side to both end sides in the scanning direction.

As depicted in FIGS. 3 and 4, the unit holding plate 26 has four openings 26*a* that respectively expose the ink jetting surfaces 25*a* of the four head units 25. The unit holding plate 26 is joined to a lower surface of the head holder 20, so as to cover the four head units 25 from below. However, the ink jetting surface 25*a* of each of the head units 25 is exposed from the opening 26*a* of the unit holding plate 26.

<Head Unit>

Next, a structure of the head unit 25 will be described in detail. As depicted in FIG. 5, the head unit 25 has an external shape which is long in the conveyance direction and substantially rectangular in planar view. As depicted in FIG. 6, the head unit 25 includes a holder member 32 and a head main body 33 that is held in the holder member 32. Two ink channels 34 are formed in the holder member 32. The two ink channels 34 are respectively connected to two cylindrical channels 27, via ink channels (illustration of which is omitted) formed in the head holder 20.

The head main body 33 includes a first channel substrate 36, a second channel substrate 37, a nozzle plate 38, piezoelectric elements 39, a protective member 40, and so on.

The first channel substrate 36 is a silicon single crystal substrate. The first channel substrate 36 has pressure chambers 41 formed therein to respectively correspond to the nozzles 30. The pressure chambers 41 form two pressure chamber rows arranged in the scanning direction. Each of the pressure chamber rows extends in the conveyance direction. Moreover, the first channel substrate 36 includes a vibrating film 45 that covers the pressure chambers 41.

The second channel substrate 37 is a silicon single crystal substrate, and is joined to a lower surface of the first channel substrate 36. The second channel substrate 37 has formed therein two manifolds 42 that respectively communicate with the two ink channels 34 of the holder member 32. Ink supplied to the cylindrical channel 27 from the ink cartridge 15 (refer to FIG. 1) is supplied to the manifold 42 via the ink channel 34 of the holder member 32.

The two manifolds 42 each extend in the conveyance direction (a direction perpendicular to the paper surface of FIG. 6) in a region overlapping in an up-down direction with the pressure chambers 41 of the first channel substrate 36. A lower end of each of the manifolds 42 is covered by a film 46 made of a synthetic resin. Moreover, the unit holding plate 26 that holds the head units 25 is disposed on a lower side of the film 46. The second channel substrate 37 has communicating holes 43 formed therein to respectively communicate the manifolds 42 and the pressure chambers 41. Furthermore, the second channel substrate 37 also has communicating holes 44 formed therein to respectively communicate the pressure chambers 41 and the nozzles 30 formed in the nozzle plate 38.

The nozzle plate 38 is a plate formed by silicon, for example, and is joined to a lower surface of the second channel substrate 37. The nozzles 30 arranged in the conveyance direction are formed in the nozzle plate 38. As mentioned above, the nozzles 30 form the two nozzle rows 31. Each of the nozzles 30 communicates with a corresponding pressure chamber 41 formed in the first channel substrate 36, via the communicating hole 44 formed in the second channel substrate 37.

The piezoelectric elements 39 are disposed on an upper surface of the vibrating film 45 parallel to the ink jetting surface 25*a*, so as to respectively correspond to the pressure chambers 41. The piezoelectric elements 39 form two piezoelectric element rows 49 arranged in the scanning direction. Each of the piezoelectric element rows 49 extends in the conveyance direction. Each of the piezoelectric elements 39 vibrates the vibrating film 45 utilizing piezoelectric deformation when an applied voltage changes, and imparts to ink within a corresponding pressure chamber 41 a jetting energy for discharging the ink from the nozzle 30. An individual wiring 47 for applying a certain drive voltage is connected to each of the piezoelectric elements 39. Moreover, a common wiring (illustration of which is omitted) which is common to the piezoelectric elements 39 is connected to the piezoelectric elements 39. The individual wirings 47 and the common wiring are formed by gold (Au), and are led out to a region between the two piezoelectric element rows 49, from the piezoelectric elements 39. An end portion on an opposite side to the piezoelectric element 39, of each of the individual wirings 47 is provided with a drive contact 47*a* to which the COF 22 is connected. Moreover, an end portion on an opposite side to the piezoelectric element 39, of the common wiring is provided with a ground contact (illustration of which is omitted) to which the COF 22 is connected. The drive contacts 47*a* of the individual wirings 47 and the ground contact of the common wiring are disposed in a region between the two piezoelectric element rows 49, on the upper surface of the vibrating film 45. Note that the drive contacts 47*a* and the ground contact are also formed by gold (Au), and that the thermal expansion coefficient of gold is about 14 ppm.

Two protective members 40 respectively covering the two piezoelectric element rows 49 are disposed on the upper surface of the vibrating film 45 of the first channel substrate 36. The protective member 40 is provided for a purpose such as isolating the piezoelectric element 39 from outside air and preventing it from coming into contact with moisture.

<COF>

As depicted in FIG. 4, a COF 22 (Chip on Film) as a flexible wiring member is connected to each of the head units 25. As depicted in FIG. 6, the COF 22 includes: a base material 22*a* made of polyimide, for example: copper (Cu) wirings 29 formed on the base material 22*a*; a solder resist 22*c* (an example of a protective film of the present teaching) that covers the base material 22*a* and the wirings 29; and a driver IC 28 mounted on the base material 22*a*. In addition, the COF 22 includes: a joining portion 22*e* (an example of a first portion of the present teaching) that runs along the vibrating film 45 of the head unit 25 and is joined to the vibrating film 45; an extending portion 22*f* (an example of a second portion of the present teaching) that extends upwardly so as to separate from the head unit 25; and a bent portion 22*g* between the joining portion 22*e* and the extending portion 22*f*.

The joining portion 22*e* of the COF 22 is adhered by an adhesive to the vibrating film 45, between the two left and right piezoelectric element rows 49, in a state where the solder resist 22*c* faces the vibrating film 45. An anisotropic conductive film (ACF) made of a resin and including conductive particles is, for example, employed as the adhesive. In more detail, in the joining portion 22*e* of the COF 22, terminals of the wirings 29 are exposed from the solder resist 22*c*. The terminals exposed from the solder resist 22*c*, and the drive contacts 47*a* and the ground contact respectively led out from the piezoelectric elements 39 are electrically connected via the conductive particles included in the anisotropic conductive film. However, when adhering using an adhesive that does not include conductive particles, the terminals exposed from the solder resist 22*c* may respectively make direct contact with the drive contacts 47*a* and the ground contact, thereby being electrically connected. Note that a thermal expansion coefficient of the anisotropic conductive film is about 30-100 ppm, and a thermal expansion coefficient of the solder resist 22*c* is about 100-200 ppm. In the present embodiment, a length in the scanning direction of the joining portion 22*e* of the COF 22 is approximately 1 mm.

The driver IC 28 is mounted in the extending portion 22*f* of the COF 22. In the present embodiment, a distance in the up-down direction from the vibrating film 45 to a lower end of the driver IC 28 is approximately 7 mm. Moreover, a width in the scanning direction of the driver IC 28 is approximately 1 mm. The driver IC 28 supplies a drive signal to the piezoelectric elements 39 of the head unit 25, and changes a voltage applied to the piezoelectric elements 39, based on a signal inputted from the later-mentioned circuit substrate 23.

Figure 7A:
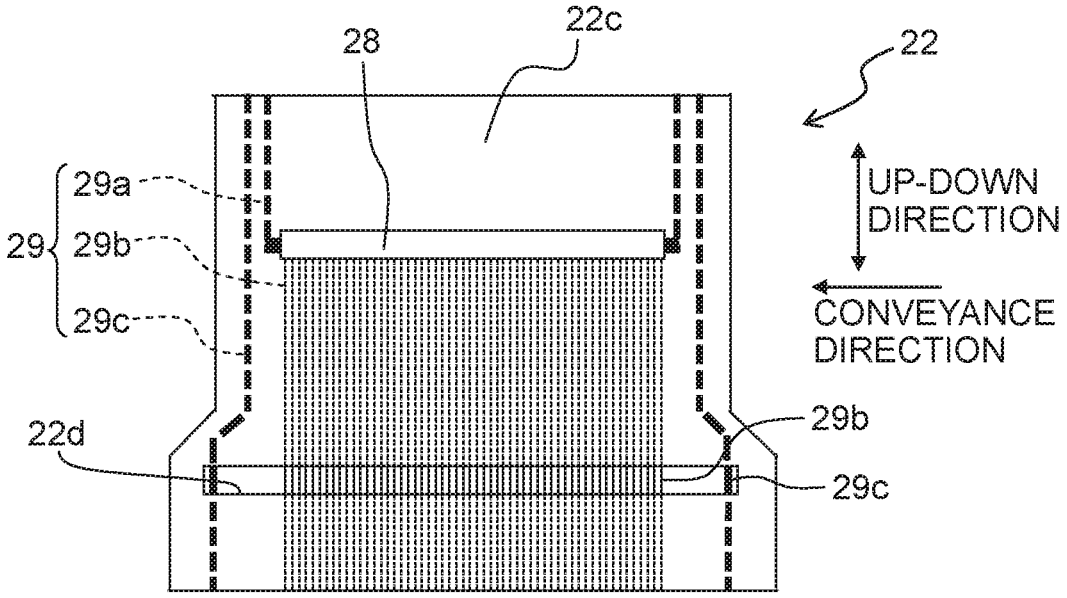
FIGS. 7A and 7B are views depicting arrangements of a driver IC and wirings in a COF, with FIG. 7A depicting a state where a heat spreader has not been disposed, and FIG. 7B depicting a state where the heat spreader has been disposed.
Figure 7B:
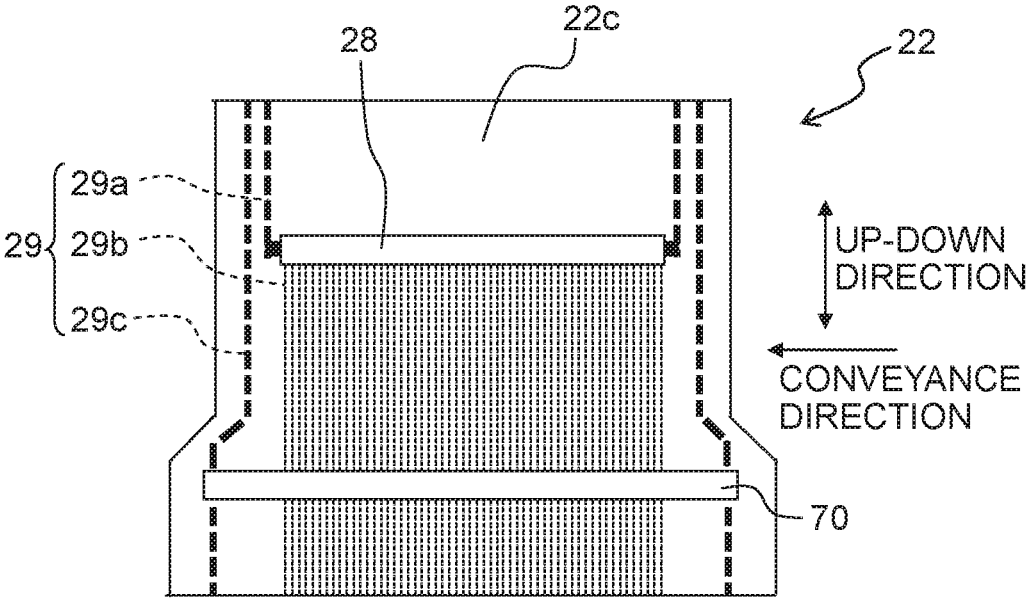

In the extending portion 22*f* of the COF 22, input wirings 29*a* (refer to FIGS. 7A and 7B) electrically connecting the circuit substrate 23 and the driver IC 28, are disposed between the driver IC 28 and the circuit substrate 23. The input wiring 29*a* transmits from the circuit substrate 23 to the driver IC 28 a signal for controlling the driver IC 28. On the other hand, in the extending portion 22*f* of the COF 22, output wirings 29*b* and a ground wiring 29*c* (refer to FIGS. 7A and 7B) electrically connecting the driver IC 28 and the piezoelectric elements 39 of each of the head units 25, are disposed below the driver IC 28, that is, between the driver IC 28 and the bent portion 22*g*. Each of the output wirings 29*b* supplies to a corresponding piezoelectric element 39, via a corresponding drive contact 47*a*, a drive signal outputted from the driver IC 28. On the other hand, the ground wiring 29*c* is connected to the ground contact. As depicted in FIG. 7A, in the extending portion 22*f* of the COF 22, an opening 22*d* is formed in the solder resist 22*c* below the driver IC 28, that is, between the driver IC 28 and the bent portion 22*g*. The opening 22*d* has a rectangular shape which is long in the conveyance direction, and a part of each of the output wirings 29*b* and a part of each of the ground wirings 29*c* are exposed from the opening 22*d*. In the present embodiment, a length in the conveyance direction of the opening 22*d* is approximately 30 mm, and its width in the up-down direction is approximately 2 mm.

Moreover, a heat spreader 70 is adhered by an adhesive, via the opening 22*d* of the solder resist 22*c*, to the extending portion 22*f* of the COF 22. As a result, the heat spreader 70 directly contacts the part of each of the output wirings 29*b* and the part of each of the ground wirings 29*c* that have been exposed from the opening 22*d* of the solder resist 22*c*. The heat spreader 70 is a member that transmits to the later-mentioned heat sink 24 heat that has been generated by the driver IC 28 and has been transmitted to the output wirings 29*b* and ground wirings 29*c*. The heat spreader 70 may be formed by, for example, dicing a thin plate of an insulating material of high thermal conductivity, such as silicon, aluminum, or silicon carbide to convert into small pieces. Note that a width in the scanning direction of the heat spreader 70 is approximately 2 mm. Moreover, an adhesive composed mainly of an epoxy resin, for example, may be used as the adhesive. In this case, the adhesive functions also as an underfilling agent for moisture-proofing of each of the output wirings 29*b* and the ground wirings 29*c*.

<Circuit Substrate>

As depicted in FIGS. 2 to 4, the circuit substrate 23 is disposed above the four head units 25 sandwiching the head holder 20, and is housed in the substrate housing portion 20*b* of the head holder 20. The circuit substrate 23 is disposed so as to overlap with the four head units 25 in the up-down direction. As depicted in FIGS. 3 and 4, connectors 53 (53*a*, 53*b*) are respectively provided to upper surfaces of a left end portion and a right end portion of the circuit substrate 23. Moreover, as depicted in FIG. 4, insertion holes 20*d* into which are inserted wiring members (illustration of which is omitted) for connecting the circuit substrate 23 and the controller 6 (refer to FIG. 1), are respectively formed in a left wall and a right wall of the head holder 20. Note that the connectors 53 may be provided on a lower surface of the circuit substrate 23, or may be provided on both of the upper surface and the lower surface of the circuit substrate 23. Four through-holes 50*a*-50*d* penetrated by the four COFs 22 extending from the four head units 25 below the circuit substrate 23, are formed aligned in the scanning direction, in the circuit substrate 23. Moreover, eight channel holes 51*a*-51*h* penetrated by the eight cylindrical channels 27 of the head holder 20, are also formed in the circuit substrate 23. Note that although in the present embodiment, as depicted in FIG. 3, the six channel holes 51*b*-51*g*, of the eight channel holes 51*a*-51*h* are linked to the through-holes 50, the through-holes 50 and the channel holes 51 may be provided independently of each other, without being linked.

As depicted in FIG. 4, vicinities of edge portions of the four through-holes 50*a*-50*d*, on the upper surface of the circuit substrate 23 are respectively provided with four connecting terminals 52. In more detail, the two through-holes 50*a*, 50*b* positioned on the left side are provided with the connecting terminals 52 on their left side (a connector 53*a* side). Moreover, the two through-holes 50*c*, 50*d* positioned on the right side are provided with the connecting terminals 52 on their right side (a connector 53*b* side). The two connecting terminals 52 on the left side are connected to the connector 53*a* on the left side, via wirings 54 or circuit elements (illustration of which is omitted) disposed on the circuit substrate 23. Similarly, the two connecting terminals 52 on the right side are connected to the connector 53*b* on the right side, via wirings 54 or circuit elements (illustration of which is omitted) disposed on the circuit substrate 23. Each of the COFs 22 passes through a corresponding through-hole 50 to be connected to a connecting terminal 52 provided on the upper surface of the circuit substrate 23.

<Heat Sink>

The heat sink 24 is a member provided for dissipating, to outside, heat generated by the driver IC 28, in more detail, heat that has been generated by the driver IC 28 and has been transmitted to the output wiring lines 29*b* and the ground wiring lines 29*c* of the COF 22. In the present embodiment, the heat sink 24 is formed by a metal material of high thermal conductivity, such as aluminum.

As depicted in FIGS. 3 and 4, the heat sink 24 is disposed between the four head units 25 and the circuit substrate 23. Moreover, the heat sink 24 is disposed with a gap between itself and the circuit substrate 23, on a lower side of the circuit substrate 23. As depicted in FIGS. 3 and 4, the heat sink 24 includes: a main body portion 55 disposed so as to extend along a surface parallel to the ink jetting surface 25*a* and straddle the four head units 25; and four projections 56 respectively projecting downwardly from this main body portion 55. The four projections 56 are disposed aligned in the scanning direction, correspondingly to the four COFs 22 respectively extending from the four head units 25. Moreover, each of the projections 56 extends not only in the up-down direction but also in the conveyance direction, and has a length in the convevance direction which is larger than a width in the up-down direction.

As depicted in FIG. 3, three wiring through-holes 57 (57*a*-57*c*) aligned in the scanning direction, are formed in the main body portion 55 of the heat sink 24. The COFs 22 extending into the circuit substrate 23 from the head units 25 penetrate the main body portion 55 in the up-down direction, at the wiring through-holes 57. The three wiring through-holes 57*a*-57*c* are rectangular shaped holes that are long along the conveyance direction. A width in the scanning direction of the wiring through-hole 57*a* positioned in the center in the scanning direction, is larger than those of the two wiring through-holes 57*b*, 57*c* to left and right. The two COFs 22 respectively connected to the two head units 25 in the center, of the COFs 22 of the four head units 25, pass through the wiring through-hole 57*a* in the center of the heat sink 24. In other words, wiring through-holes passed through by the two COFs 22 in the center are linked to form one wiring through-hole 57*a*. The COF 22 of the left end head unit 25 passes through the wiring through-hole 57*b* on the left side of the heat sink 24, and the COF 22 of the right end head unit 25 passes through the wiring through-hole 57*c* on the right side of the heat sink 24.

Two of the projections 56 respectively extend downwardly from two left and right edge portions of the central wiring through-hole 57*a*. Moreover, the two heat spreaders 70 respectively provided to the two COFs 22 that penetrate the central wiring through-hole 57*a*, are supported in a state of respectively contacting the two central projections 56. In addition, one projection 56 extends downwardly from a left side edge portion of the left side wiring through-hole 57*b*, and the heat spreader 70 provided to the COF 22 that penetrates this left side wiring through-hole 57*b*, is supported in a state of contacting the projection 56. One projection 56 extends downwardly also from a right side edge portion of the right side wiring through-hole 57*c*, and the heat spreader 70 provided to the COF 22 that penetrates this right side wiring through-hole 57*c*, is supported in a state of contacting the projection 56. Note that as mentioned above, the width in the scanning direction of the heat spreader 70 is larger than the width in the scanning direction of the driver IC 28. Therefore, as depicted in FIG. 6, the heat spreader 70 contacts the projection 56, but the driver IC 28 does not contact the projection 56.

A total of six channel through-holes 58 are formed in a region between the three wiring through-holes 57*a*-57*c*, a region more to a left side than the left side wiring through-hole 57*b*, and a region more to a right side than the right side wiring through-hole 57*c*, of the main body portion 55. As depicted in FIGS. 2 and 4, the cylindrical channels 27 of the head holder 20 penetrate the main body portion 55 in the up-down direction, at each of the channel through-holes 58.

Note that the heat sink 24 having the above-described shape is formed by applying a press processing to a plate-like base material 60 made of a metal such as aluminum. The base material 60 has a substantially rectangular planar shape. Due to a bending processing by a press, one portion of the base material 60 is separated from the base material 60 except for along a bent portion 60*a*, and is bent at the bent portion 60*a*. Moreover, the previously mentioned one portion bent at the bent portion 60*a* of the base material 60 forms the projection 56 that extends downwardly, and a remaining portion of the base material 60 forms the main body portion 55 that extends along a horizontal plane. In addition, a hole formed in the base material 60 by the projection 56 being bent downwardly, forms the wiring through-hole 57. Moreover, the six channel through-holes 58 are formed in the base material 60 by a punching processing by a press.

When the piezoelectric elements 39 of the head unit 25 are driven by the driver IC 28, the driver IC 28 generates heat. Due to the present embodiment, heat arising in each of the driver ICs 28 is transmitted to the heat spreader 70 via the output wirings 29*b* and ground wirings 29*c*, and is further transmitted to the projection 56 and main body portion 55 of the heat sink 24. As a result, some of the heat generated by the driver IC 28 is dissipated to peripheral outside air. In other words, the heat spreader 70 directly contacts the output wirings 29*b* and ground wirings 29*c* that connect the driver IC 28 and the drive contacts 47*a* and ground contacts. Therefore, it can be efficiently prevented that heat generated by the driver IC 28 is transmitted as far as the drive contacts 47*a* and ground contacts via the output wirings 29*b* and ground wirings 29*c*.

Next, modified embodiments in which a variety of modifications are made to the previously described embodiment, will be described. However, configurations that are similar to in the previously described embodiment will be assigned with the same reference symbols as those assigned in the previously described embodiment, and descriptions thereof will be appropriately omitted.

Figure 8:
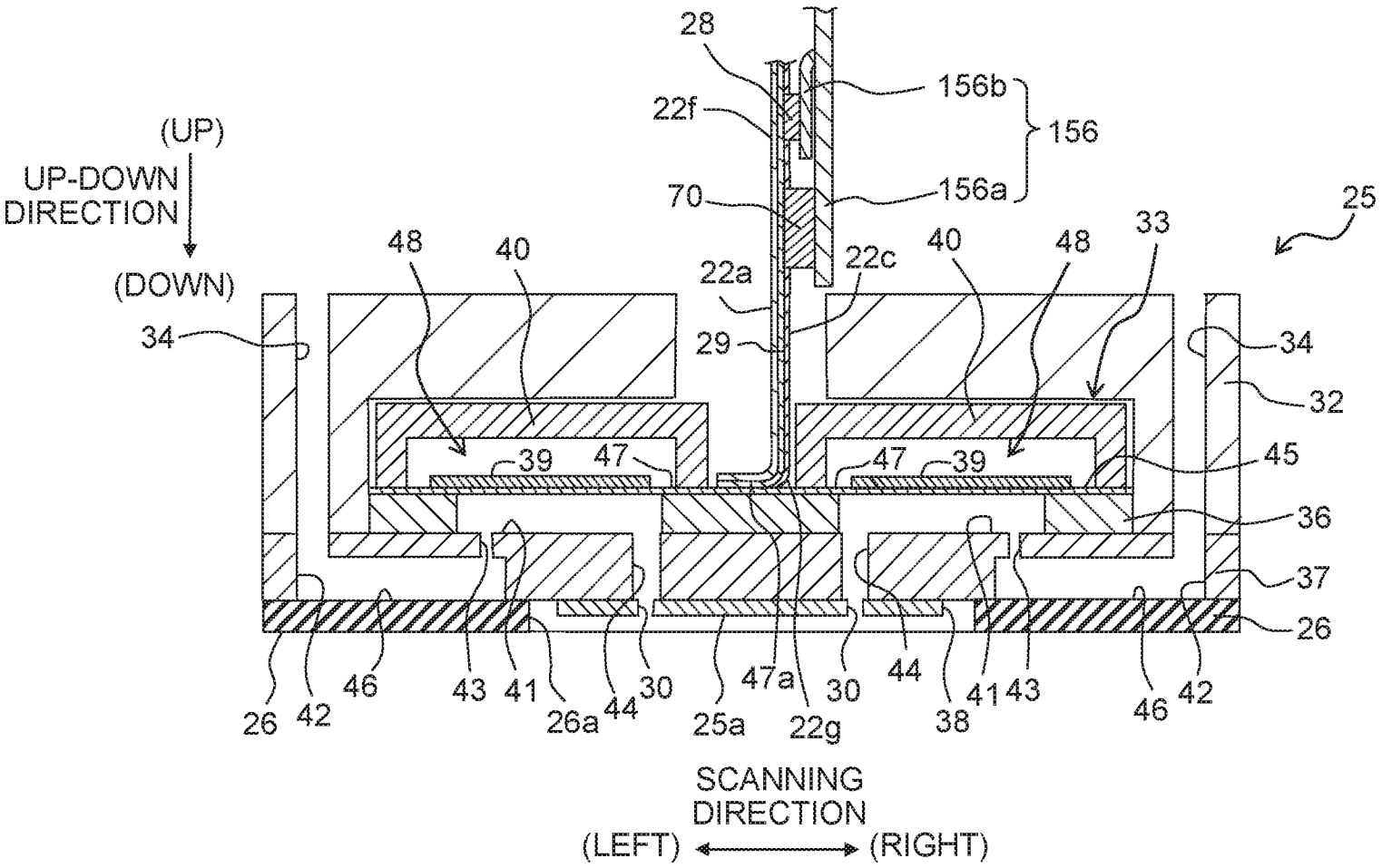
FIG. 8 is a view corresponding to FIG. 6 and depicting a heat sink according to a first modified embodiment.
Figure 9:
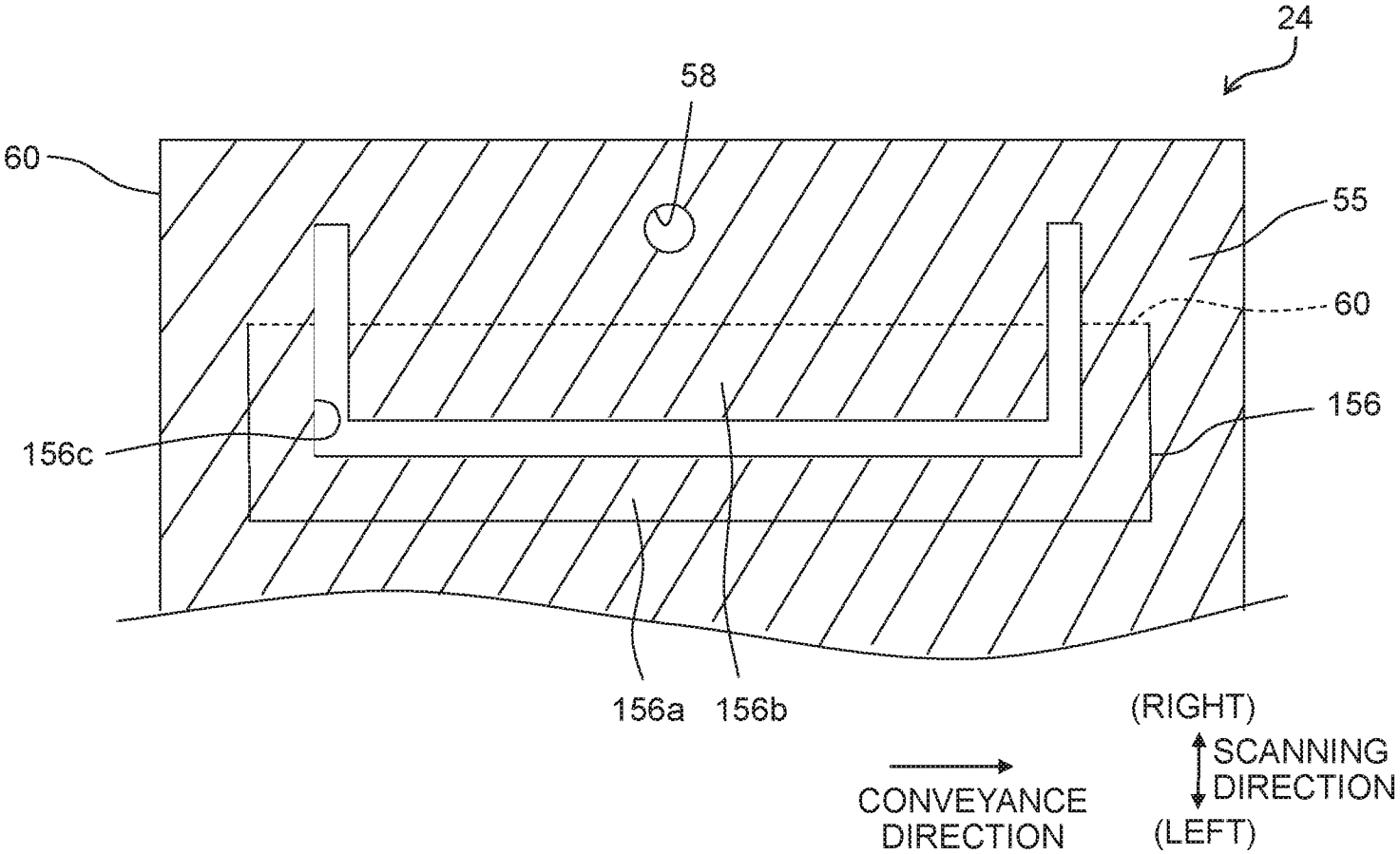
FIG. 9 is a view depicting a state before bending processing, of the heat sink according to the first modified embodiment.

In the above-described embodiment, the projection 56 of the heat sink 24 contacted only the heat spreader 70, and did not contact the driver IC 28. However, the present teaching is not limited to this. For example, as depicted in FIGS. 8 and 9, a projection 156 of the heat sink 24 may include: a first projection 156*a* (an example of a first portion of the present teaching) that contacts the heat spreader 70; and a second projection 156*b* (an example of a second portion of the present teaching) that contacts the driver IC 28 (first modified embodiment). As depicted in FIG. 9, a through-hole 156*c* (an example of a slit of the present teaching) which is U-shaped in planar view is formed in the base material 60 forming the heat sink 24, in such a manner that the through-hole 156*c* straddles the projection 156 and the main body portion 55. Moreover, a portion surrounded by the through-hole 156*c* and the bent portion 60*a* of the projection 156 forms the second projection 156*b*, and a portion excluding the second projection 156*b* and the through-hole 156*c* of the projection 156 forms the first projection 156*a*. Now, as depicted in FIG. 8, the width in the scanning direction of the driver IC 28 is smaller than the width in the scanning direction of the heat spreader 70. Therefore, the second projection 156*b* contacts the driver IC 28 in a state of having been drawn out toward the driver IC 28 from the first projection 156*a*.

Due to the above-described first modified embodiment, the second projection 156*b* directly contacts the driver IC 28, so heat generated by the driver IC 28 can be dissipated more efficiently. Moreover, the through-hole 156*c* which is U-shaped in planar view extends from the projection 156 to the main body portion 55. Therefore, heat that has been transmitted to the second projection 156*b* from the driver IC 28 is transmitted to the main body portion 55 before being transmitted to the first projection 156*a*. In other words, heat generated by the driver IC 28 is hardly transmitted to the first projection 156*a*.

Figure 10:
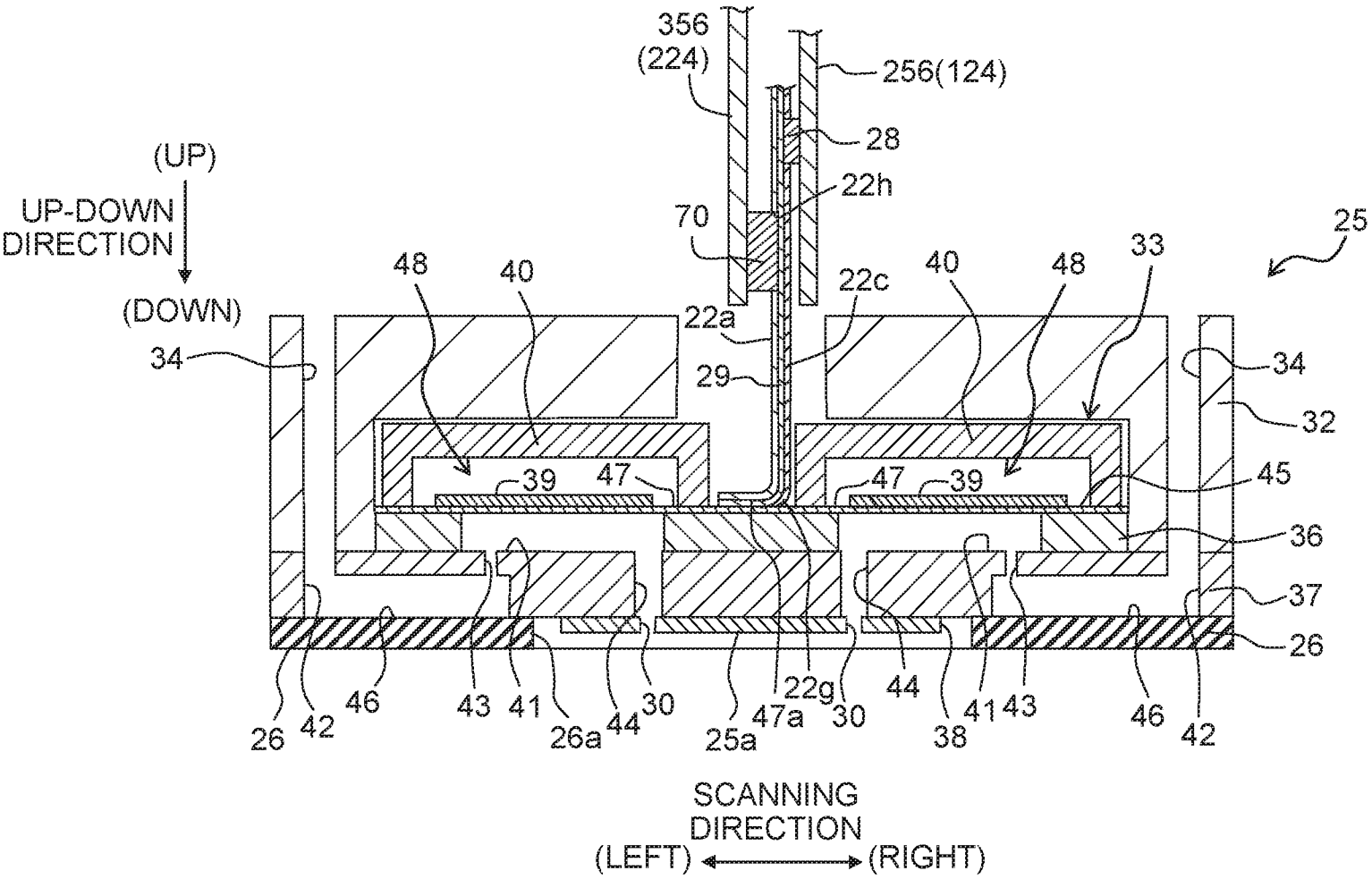
FIG. 10 is a view corresponding to FIG. 6 and depicting a heat sink according to a second modified embodiment.

In the above-described embodiment, the projection 56 of the heat sink 24 contacted only the heat spreader 70, and did not contact the driver IC 28. However, the present teaching is not limited to this. For example, as depicted in FIG. 10, the heat spreader 70 may be installed on a surface opposite to a surface where the driver IC 28 of the COF 22 is mounted, and there may be provided: a first heat sink 124 having a projection 256 that contacts the driver IC 28; and a second heat sink 224 having a projection 356 that contacts the heat spreader 70 (second modified embodiment). In this case, the heat spreader 70 should be adhered by an adhesive, to the extending portion 22*f* of the COF 22, via an opening 22*h* formed in the base material 22*a* of the COF 22. As a result, the heat spreader 70 directly contacts a part of each of the output wirings 29*b* and a part of each of the ground wirings 29*c*, that are exposed from the opening 22*h* of the base material 22*a*. Note that the first heat sink 124 should be disposed between the head holder 20 and the circuit substrate 23, similarly to in the above-described embodiment, and the second heat sink 224 should be disposed above the circuit substrate 23.

Due to the above-described second modified embodiment, the driver IC 28 and the heat spreader 70 are respectively contacted by the dedicated first heat sink 124 and second heat sink 224, so not only can heat transmitted to the output wirings 29*b* and ground wirings 29*c* be efficiently dissipated, but also heat generated by the driver IC 28 can be efficiently dissipated.

Figure 11:
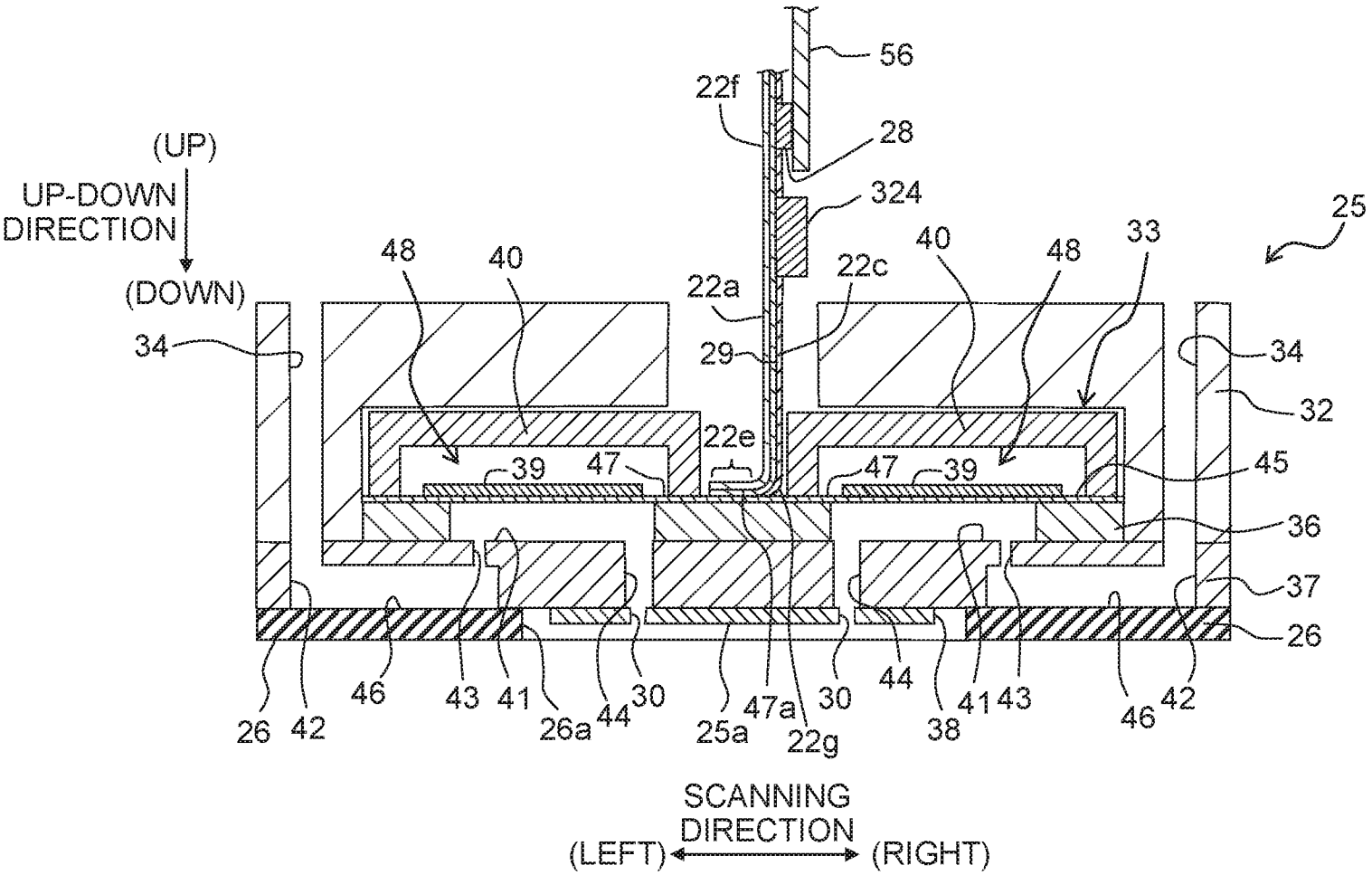
FIG. 11 is a view corresponding to FIG. 6 and depicting a heat sink according to a third modified embodiment.
Figure 12:
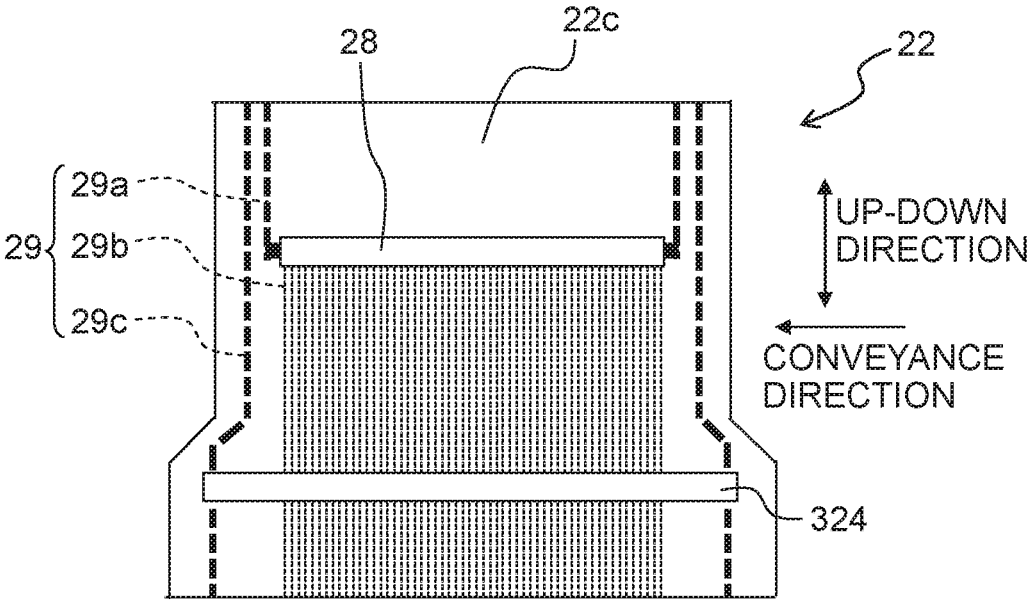
FIG. 12 is a view corresponding to FIG. 7B and depicting the heat sink according to the third modified embodiment.

In the above-described embodiment, the heat spreader 70 was employed as a member for transmitting to the heat sink 24 heat transmitted to the output wirings 29*b* and ground wirings 29*c* of the COF 22. However, the present teaching is not limited to this. For example, as depicted in FIGS. 11 and 12, a member the same as the heat spreader 70 of the above-described embodiment may be adhered, as a heat sink 324, to the extending portion 22*f* of the COF22, by an adhesive. That is, the heat sink 324 may be formed by, for example, dicing to convert into small pieces a thin plate of an insulating material of high thermal conductivity, such as silicon, aluminum, or silicon carbide. The heat sink 324 directly contacts a part of each of the output wirings 29*b* and a part of each of the ground wirings 29*c*, that are exposed from the opening 22*d* of the solder resist 22*c*, but, as depicted in FIG. 1, does not contact the projection 56 of the heat sink 24 (third modified embodiment). In this case, heat transmitted to the output wirings 29*b* and ground wirings 29*c* of the COF 22 is transmitted directly to the heat sink 324 and dissipated to outside. Note that a surface excluding an adhesion surface of the COF 22, of the heat sink 324 may have formed therein concavities/convexities for increasing its surface area and thereby increasing a heat dissipation effect. Moreover, although in the present modified embodiment, the opening 22*d* is formed in the solder resist 22*c*, the opening 22*d* may be formed in the base material 22*a*. Moreover, the heat sink 324 may be adhered by an adhesive, to the extending portion 22*f* of the COF 22, via the opening 22*d* formed in the base material 22*a*. As a result, the heat sink 324 may directly contact a part of each of the output wirings 29*b* and a part of each of the ground wirings 29*c*, that are exposed from the opening 22*d* of the base material 22*a*.

Figure 13:
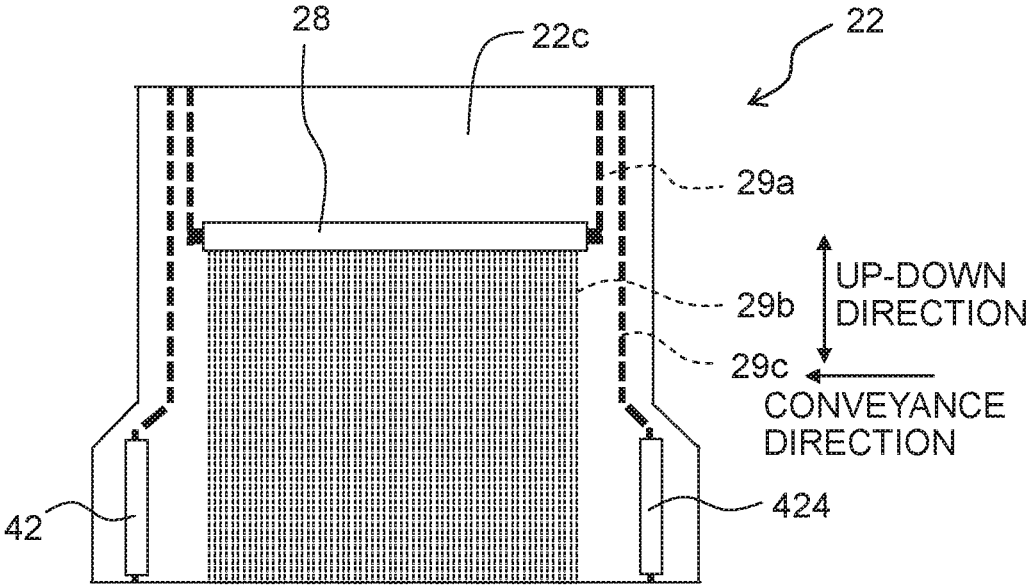
FIG. 13 is a view corresponding to FIG. 7B and depicting a heat sink according to a fourth modified embodiment.

In the above-described third modified embodiment, the heat sink 324 contacted a part of each of the output wirings 29*b* and a part of each of the ground wirings 29*c*. However, the present teaching is not limited to this. For example, as depicted in FIG. 13, heat sinks 424 may contact a part of each of the ground wirings 29*c* only, without contacting the output wirings 29*b* (fourth modified embodiment). In this case, the heat sink 424 contacts only the ground wirings 29*c*, and does not contact the output wirings 29*b*, so there is no risk of a short circuit occurring between the ground wirings 29*c* and the output wirings 29*b*. This makes it possible to employ a metal material of high thermal conductivity, not an insulating material, as the heat sink 424.

The above-described fourth modified embodiment also enables heat transmitted to the ground wirings 29*c* to be efficiently dissipated.

Figure 14:
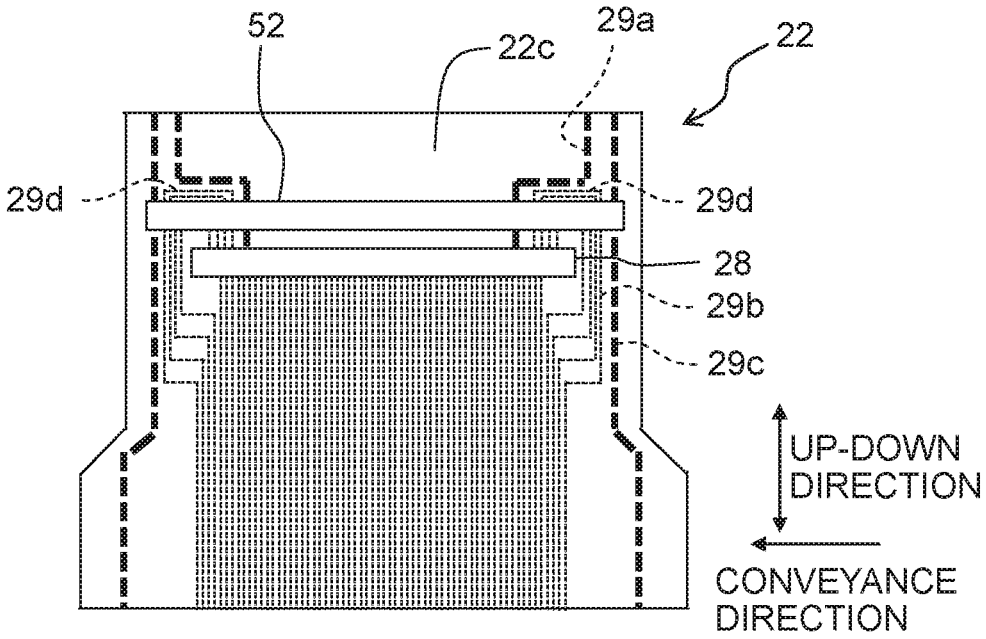
FIG. 14 is a view corresponding to FIG. 7B and depicting a heat sink according to a fifth modified embodiment.

The heat sink 324 of the above-described third modified embodiment and the heat sink 424 of the above-described fourth modified embodiment were installed below the driver IC 28. However, the present teaching is not limited to this. For example, as depicted in FIG. 14, when some of the output wirings 29*b* of the output wirings 29*b* are led out more to an upper side than the driver IC 28, and then detour along a side of the driver IC 28 before extending below the driver IC 28, a heat sink 524 may be installed more upwardly than the driver IC 28 is. Moreover, the heat sink 524 may contact a part of each of the input wirings 29*a*, a portion 29*d* led out more to an upper side than the driver IC 28, of the some of the output wirings 29*b* of the output wirings 29*b* (an example of a lead-out section of the present teaching), and a part of each of the ground wirings 29*c* (fifth modified embodiment).

The above-described fifth modified embodiment also enables heat transmitted to the output wirings 29*b* and ground wirings 29*c* to be efficiently dissipated.

A COF 22 is merely one example of the wiring member of the present teaching, and the wiring member of the present teaching may include a flexible base material and wirings formed in the base material, as in a flexible wiring substrate (FPC), for example. Further, the ink jetting apparatus 3 may include a heater configured to heat the ink to be supplied to the head units 25.

In the embodiment described above, the present teaching was applied to the ink-jet head which jets ink onto a recording sheet to print an image or the like. However, the present teaching may be applied also to a liquid jetting apparatus used in a variety of applications besides printing of an image or the like. For example, it is possible to apply the present teaching also to a liquid jetting apparatus which jets conductive liquid onto a substrate to form a conductive pattern on a substrate surface.

What is claimed is:

1. A liquid jetting apparatus comprising:
a liquid jetting module having drive elements;
a wiring member including: a base material having a first surface; wirings formed on the first surface of the base material; and a protective film configured to cover the first surface of the base material and the wirings; and
a heat sink,
wherein one of the protective film and the base material, of the wiring member, is formed with an opening through which at least some of the wirings are partially exposed,
the wirings of the wiring member are electrically connected to terminals of the drive elements, and
the heat sink is joined to the at least some of the wirings via the opening of the wiring member.

2. The liquid jetting apparatus according to claim 1,
wherein the wiring member includes:
a first portion joined to the liquid jetting module;
a second portion led out in a direction separating from the liquid jetting module; and
a bent portion between the first portion and the second portion, and
the opening is formed in the second portion of the wiring member.

3. The liquid jetting apparatus according to claim 2,
wherein the wiring member has a driver IC which is electrically connected to the wirings, and
the driver IC is disposed in the second portion of the wiring member.

4. The liquid jetting apparatus according to claim 3, wherein the opening of the wiring member is formed between the bent portion of the wiring member and the driver IC.

5. The liquid jetting apparatus according to claim 3, wherein the driver IC is disposed between the bent portion of the wiring member and the heat sink, certain wirings, among the wirings of the wiring member, have lead-out sections led out from the driver IC to a side opposite to the bent portion with respect to the driver IC, and the heat sink is joined to the lead-out sections of the certain wirings.

6. The liquid jetting apparatus according to claim 1, wherein the opening is formed in the protective film.

7. The liquid jetting apparatus according to claim 1, wherein the opening is formed in the base material.

8. The liquid jetting apparatus according to claim 1, wherein the wiring member is adhered, by an adhesive, to a surface of the liquid jetting module on which the terminals are formed, and a thermal expansion coefficient of the adhesive is larger than a thermal expansion coefficient of the terminals.

9. The liquid jetting apparatus according to claim 8, wherein the adhesive is an anisotropic conductive film.

10. The liquid jetting apparatus according to claim 1, further comprising a heater configured to heat liquid to be supplied to the liquid jetting module.

11. The liquid jetting apparatus according to claim 1, wherein the heat sink is made of any one material of silicon, aluminum, and silicon carbide.

12. The liquid jetting apparatus according to claim 1, wherein the terminals of the drive elements comprise: drive terminals corresponding to the drive elements respectively; and at least one ground terminal common to the drive elements, the wirings of the wiring member include: individual wirings electrically connected to the drive terminals respectively; and at least one common wiring electrically connected to the at least one ground terminal, and the heat sink is joined to the at least one common wiring without being joined to the individual wirings.

13. A liquid jetting apparatus comprising:

a liquid jetting module having drive elements;

a wiring member including: a base material having a first surface; wirings formed on the first surface of the base material; and a protective film configured to cover the first surface of the base material and the wirings, one of the protective film and the base material being formed with an opening through which at least some of the wirings are partially exposed;

a heat spreader joined to the at least some of the wirings via the opening of the wiring member; and a heat sink being a separate member from the heat spreader and being in contact with the heat spreader, wherein the wirings of the wiring member are electrically connected to terminals of the drive elements.

14. The liquid jetting apparatus according to claim 13, wherein the wiring member has a driver IC electrically connected to the wirings, and the heat sink is not in contact with the driver IC.

15. The liquid jetting apparatus according to claim 14, further comprising a second heat sink which is different from the heat sink, wherein the second heat sink is in contact with the driver IC without being in contact with the heat spreader.

16. The liquid jetting apparatus according to claim 13, wherein the wiring member has a driver IC electrically connected to the wirings, the heat sink includes: a first portion being in contact with the heat spreader; and a second portion being in contact with the driver IC, and the heat sink has a slit formed between the first portion and the second portion.

* * * * *